United States Patent [19]

Omata

[11] 4,385,869

[45] May 31, 1983

[54] RECIPROCATION PUMP

[75] Inventor: Katsumori Omata, Higashimurayama, Japan

[73] Assignee: Far East Engineering Co., Ltd., Japan

[21] Appl. No.: 198,644

[22] Filed: Oct. 20, 1980

[30] Foreign Application Priority Data

Jun. 28, 1980 [JP] Japan ..... 55-88394

[51] Int. Cl.[3] ..... F04B 35/00; F04B 1/04

[52] U.S. Cl. ..... 417/271; 417/393; 91/493

[58] Field of Search ..... 417/269, 271, 393; 91/493, 494, 480

[56] References Cited

U.S. PATENT DOCUMENTS 744,747 11/1873 Desper ..... 91/493
759,828 5/1904 Olney ..... 417/271
2,147,666 2/1939 Park ..... 417/271
3,820,445 6/1974 Klink ..... 91/481

FOREIGN PATENT DOCUMENTS 971915 1/1951 France ..... 417/517

*Primary Examiner*—William L. Freeh
*Attorney, Agent, or Firm*—Ziems & Walter

[57] ABSTRACT

A reciprocation pump has a plurality of radially arranged pumping chambers each provided with a piston and operatively connected to an external liquid absorbing pipe and an external liquid discharging pipe, and has a central drive mechanism comprising drive members each directly connected to the corresponding one of the radially arranged pistons and a valve structure operated in association with the drive members by a pressure activated fluid injected into the pump at an external inlet thereof, said valve structure sending the pressure activated fluid into and out of the pump simultaneously during the operation thereof.

3 Claims, 10 Drawing Figures

RECIPROCATION PUMP

BRIEF DESCRIPTION OF THE INVENTION

The invention relates to a reciprocation pump, and more particularly relates to a reciprocation pump operated by a pressure activated fluid, especially by a pressure activated air.

The conventional pump of the kind has been operated to make a pumping action with the pistons or diaphragms being reciprocated under the control of pressure activated driving fluid. Such a conventional pump is, therefore, provided with a driving fluid switching valve mechanism having a valve element of an axial sliding system. Especially if the driving fluid is the air, the conventional pump has been accompanied by the following defects reducing or lowering the pumping operation;

(a) The driving air switching operation of the valve is not secured if the pressure of the driving air is low, or the amount of air is small.

(b) The same switching operation of the valve is not secured if a lubricant in the driving air is lacking, or moisture is contained in the driving air.

(c) Reduction in the size and weight of the pump is almost impossible due to the structure of the valve mechanism without lowering the performance of the pump.

The present invention has been provided to eliminate such defects and disadvantages of the prior art.

It is a primary object of the invention to provide a reciprocation pump which is automatically operated when it is once furnished with a pressure activated fluid.

It is another object of the invention to provide a reciprocation pump which is simple in structure and smooth in operation only by providing reciprocating drive shafts for switching the valve of the pump.

It is another object of the invention to provide a reciprocation pump for absorbing and discharging a desired liquid with the short pulsing periods to smoothly transmit a desired liquid. It is another object of the invention to provide a reciprocation pump which may be employed in any places, and displays a specific effect and characteristic as to safety if it is employed in the fire reluctant working places such as the pits where there is a risk of gas explosion especially which may be caused by electric sparks, since the pump of the invention is operated by a pressure activated fluid such as the air.

It is still another object of the invention to provide a reciprocation pump which may be employed for absorbing and discharging the electrolyte to be used to impregnate the capacitor elements, and which may also be employed to extinguish the fires.

For attaining such objects, the reciprocation pump of the invention substantially comprises a plurality of radially arranged reciprocation pumping chambers each provided with a piston and operatively connected to the external liquid absorbing pipe and liquid discharging pipe, and a drive mechanism arranged at the center of the pumping chambers, said drive mechanism comprising drive members directly connected to the pistons of the pumping chambers respectively, and a valve structure operated in association with the drive members by a pressure activated fluid as a power source of the pump, said valve structure sending the pressure activated air into and out of the pumping chambers simultaneously during the operation of the pump.

Many other features and advantages of the invention will be apparent from the following description of a preferred embodiment in reference to the attached drawings.

DETAIL DESCRIPTION OF THE INVENTION

Figure 1:
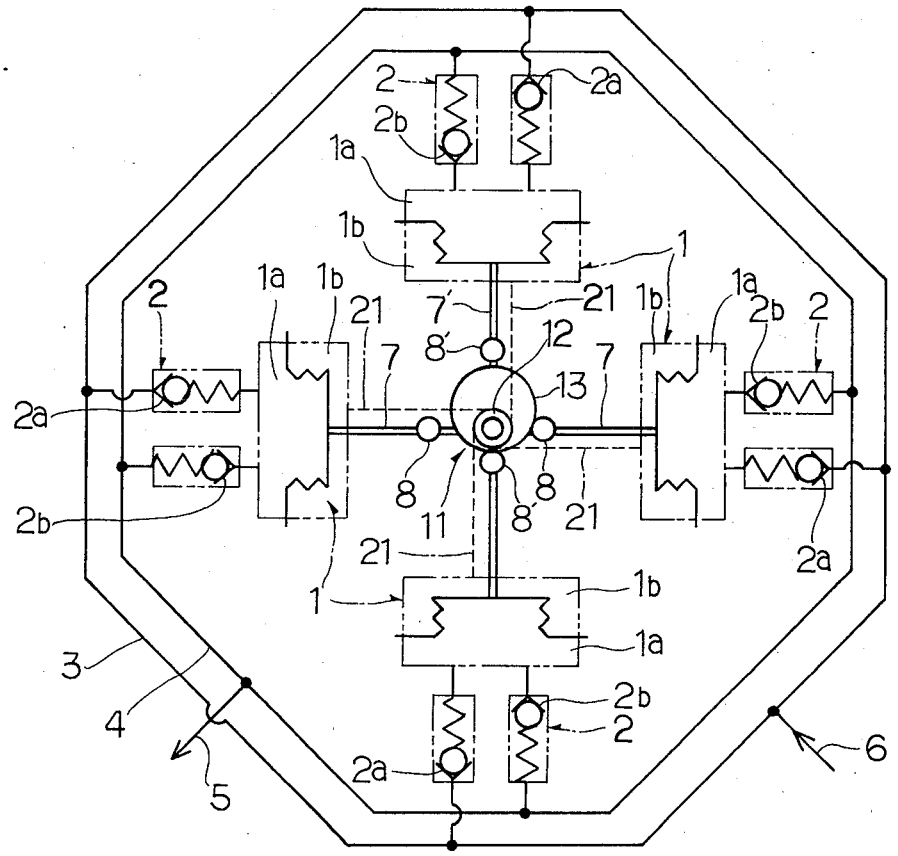
FIG. 1 is a diagramatic plan view of a reciprocation pump according to the invention.

In reference to FIG. 1, there are provided four working members or diaphragms 1 disposed at 90° as shown, each reciprocatingly driven by a pressure activated driving fluid such as the air in this embodiment. The diaphragms 1 are reciprocatingly moved to operate pumping valve units 2 each provided with a liquid absorbing valve **2*a* and a liquid discharging valve 2*b*. These liquid absorbing and discharging valves 2*a*, 2*b* are each connected to a common liquid absorbing pipe 3 and a common liquid discharging pipe 4 respectively as shown. These liquid absorbing and discharging pipe 3, 4 are connected to an external absorbing pipe 6 and an external discharging pipe 5 respectively. The diaphragm structures 1 are each composed of a pumping chamber 1*a* and a diaphragm actuating chamber 1*b*** for controlling the pressure activated driving air to be poured into and out of the chamber.

It would be needless to say that the diaphragm type may be replaced by a normally used piston type for the reciprocation pump.

Figure 2:
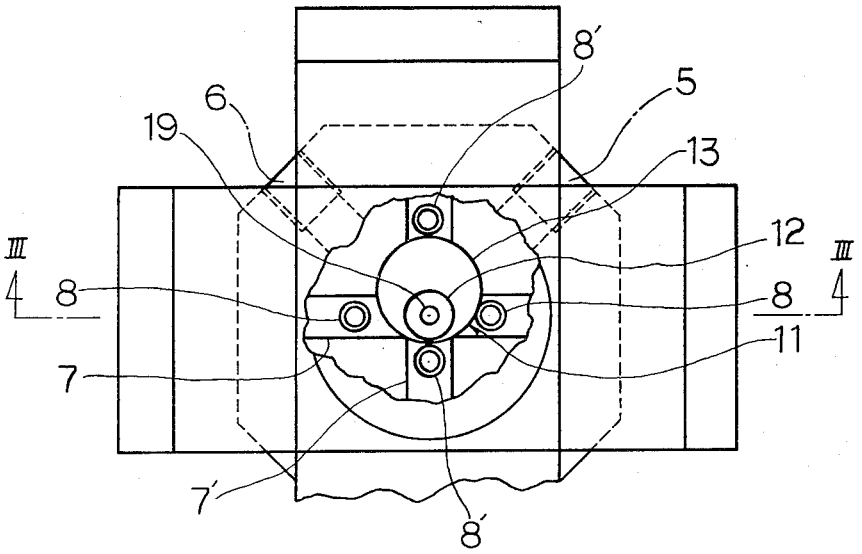
FIG. 2 is an outlined plan view of an essential portion of the invention shown partly broken away.
Figure 4:
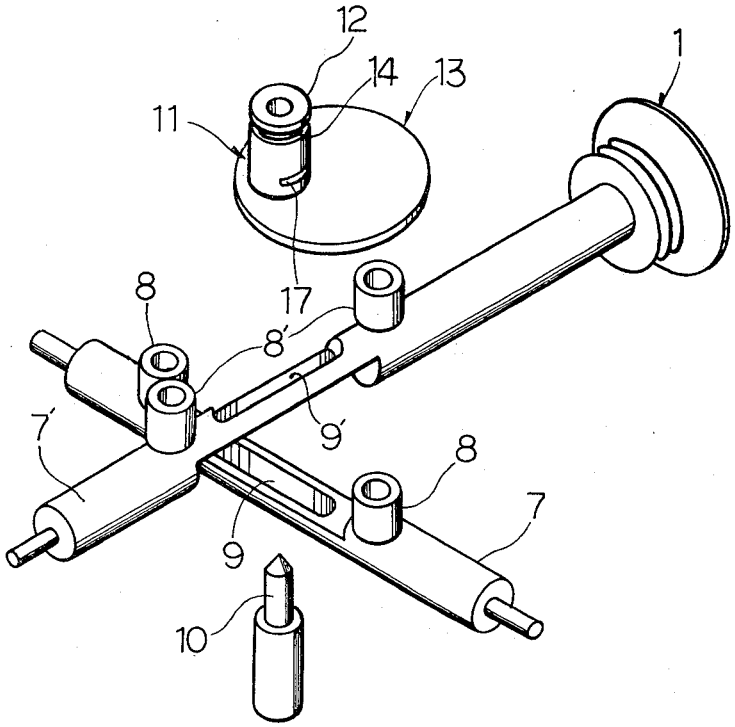
FIG. 4 is an exploded view of the essential part of the invention.

As shown in FIGS. 2 and 4, the diaphragms 1 are each secured to the ends of drive shafts 7, 7′ respectively transversing each other crossways.

As particularly shown in FIG. 4, the drive shafts 7, 7′ are each provided with a pair of spaced cylindrical projections 8, 8′, and are each formed therealong with an elongated opening 9(9′) between the projections 8, 8′. A vertical pivot 10 is arranged to be inserted into the transversed openings 9, 9′ from the underside thereof. A valve mechanism is rotatably supported on the pivot 10.

The valve mechanism is composed of a rotational switching valve member 12 and a cam disc 13, and is rotatably mounted on the upper end of the pivot 10.

Figure 5:
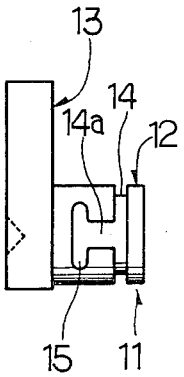
FIG. 5 is one side elevational view of a valve mechanism according to the invention.
Figure 6:
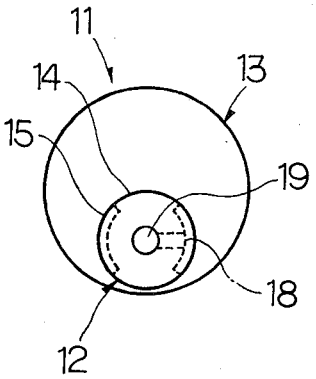
FIG. 6 is a plan view of the valve mechanism.
Figure 7:
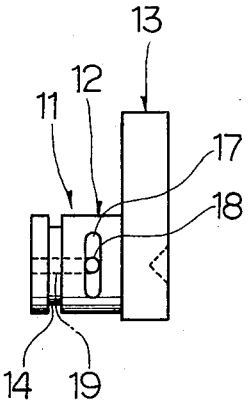
FIG. 7 is the opposite side elevational view of the valve mechanism.

In reference to FIGS. 5–7, the switching valve member 12 has the opposite sides of different structures. Namely, the switching valve member 12 has a groove 14 formed therearound at the upper part thereof, a laterally extended groove 15 formed at the lower part on one side thereof and a vertical groove **14*a* connecting the laterally extended groove 15 to the upper peripheral groove 14 as shown in FIG. 6**.

Figure 3:
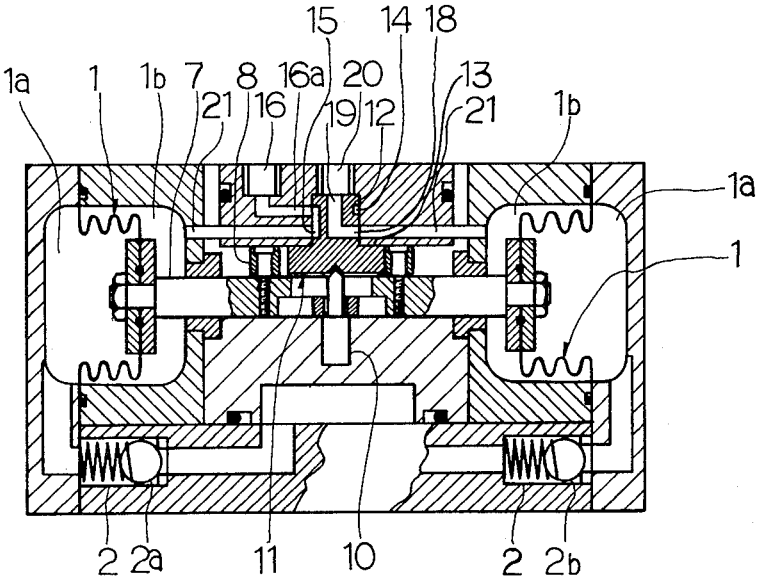
FIG. 3 is a vertical sectioned view of the invention taken along the line III—III of FIG. 2.

The upper peripheral groove 14 is connected by a channel to an external inlet 16 from which the pressure activated air is injected as shown in FIG. 3.

As shown in FIG. 7, the switching valve member 12 has another laterally extended groove 17 formed at the lower part on the side thereof diametrically opposite to the laterally extended groove 15. The groove 17 is connected to a channel 18 which is extended towards the center axis of the valve member 12 and is extended therefrom to the upper end of the valve member along the center axis thereof as indicated by a reference numeral 19, where the channel 19 is connected to an external outlet 20.

These grooves and channels of the switching valve member 12 have been provided to realize the injection and ejection of the pressure activated driving air which will be mentioned herein in reference to FIG. 3.

Namely, the laterally extended grooves 15, 17 are so arranged as to come to be connected to the respective one ends of four radially extended channels 21 during rotation of the switching valve member 12, the other ends of which being connected to the diaphragm actuating chambers 1*b* of the diaphragm 1 respectively.

Figure 8A:
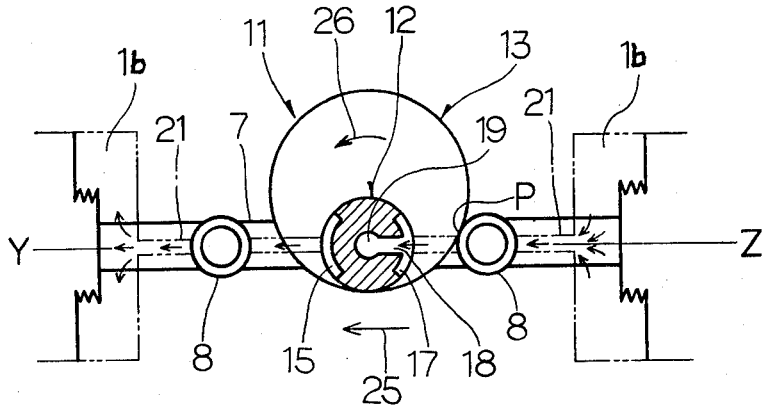
FIGS. 8A–8B are plan views of the valve mechanism of the invention shown in a sequence of operations.

In reference to FIG. 8A, the center axes of the switching valve member 12, and of the cylindrical projections 8, 8 are arranged in alignment on the center axis Y-Z of the drive shaft 7, and laterally extended grooves 15, 17 are arranged diametrically opposite to each other and symmetrical. Therefore, in the condition as shown in FIG. 8A. The groove 15 serves to inject the pressure activated air into one of the diaphragm actuating chamber 1*b* and the groove 17 serves to eject the pressure activated air from the other of the diaphragm actuating chambers 1*b*.

In this embodiment, the form pumping chambers 1 are provided. However, more pumping chambers may be required in dependence upon the dimensions and arrangement of the grooves 15, 17.

With the foregoing combination of elements, the pump of the invention is operated as follows;

In reference to FIG. 3, if the pressure activated driving air is injected at the external inlet 16, the air flows into the peripheral groove 14 of the rotational switching valve member 12, and into the laterally extended groove 15 through the vertical groove 14*a* (FIG. 5). Then the air flows into one or more of the pipes 21 in FIGS. 1 and 2, and into the related one or more of the diaphragm actuating chambers 1*b*, and there the air presses one or more of the related diaphragms 1, thereby to discharge the liquid.

Simultaneously, the opposite laterally extended groove 17 of the switching valve member 12 comes to be connected to one or more of the other pipes 21, so that the air, which has finished a piston action, may be ejected at the external outlet 20 through the air ejecting groove 17 and the channels 18, 19.

As the result, a power is applied, for example, to the drive shaft 7 in the leftward direction in FIGS. 1 and 2 due to the pressure difference between the opposite diaphragm actuating chambers 1*b*, 1*b*.

Figure 8B:
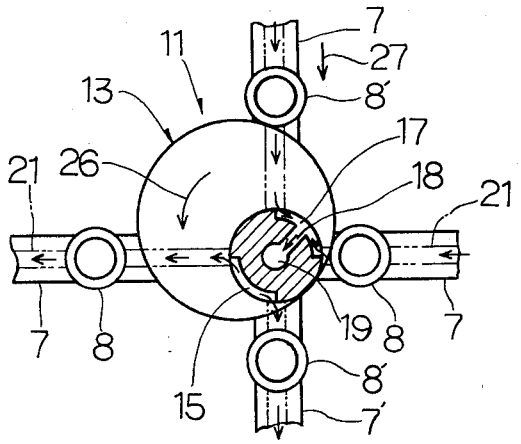
Figure 8C:
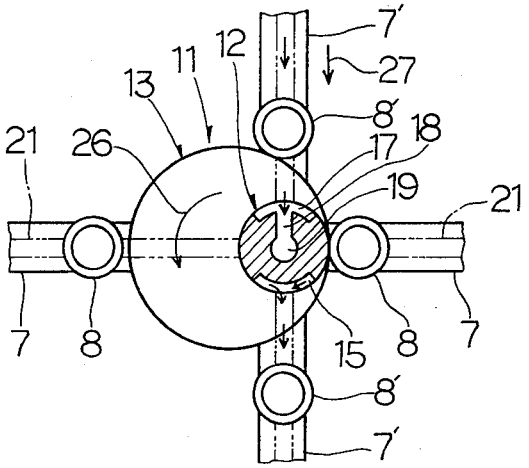

This relation can be explained in reference to the operations of elements as shown in FIGS. 8A–8C. FIG. 8A shows that the pressure activated air flows into the left side diaphragm actuating chamber 1*b* through the groove 15 and the channel 21, and the air in the right side diaphragm actuating chamber 1*b* is ejected through the groove 17, channel 18 and the outlet 19 of the valve member 12. In this condition, a power is applied to the drive shaft 7 in the direction as indicated by the arrow mark 25 due to the pressure difference between the opposite diaphragm actuating chambers 1*b*, 1*b*. As the result, the cylindrical projection 8 on the right side pushes the cam disc 13. Since the cam disc 13 and the valve member 12 are coaxial and the common axis is located on the center axis Y-Z of the drive shaft 7, and since the cylindrical projection 8, the center axis of which being located on the axis Y-Z, contacts the cam disc 13 at the point P which is slightly spaced from the axis Y-Z in the upper direction, it would be understood that a moment is produced to rotate the cam disc 13 in the counterclockwise direction as indicated by the arrow mark 26, when the projection 8 pushes the cam disc 13.

The cam disc 13 is, therefore, rotated as shown in FIG. 8B and the other opposite diaphragm actuating chambers start to inject and reject the pressure activated air respectively. Then as the drive shaft 7' is moved in the direction as indicated by the arrow mark 27, the upper projection 8' is additionally operated to push the cam disc 13.

As the cam disc 13 is further rotated in the counterclockwise direction and comes to the condition as shown in FIG. 8C, the vertically opposite diaphragm actuating chambers are in a full pumping operation while the laterally opposite diaphragm actuating chambers are at rest. The cam disc 13 is continuously rotated in the counterclockwise direction as indicated by the arrow mark 26 by the pushing action of the upper projection 8' which is moved in the direction by the arrow mark 27.

Figure 8D:
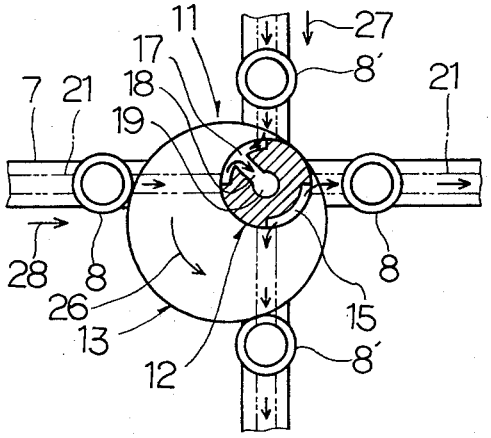

In FIG. 8D, as the groove 15 comes to be connected to the laterally extended channel 21, the drive shaft 7 starts to move in the opposite direction as indicated by the arrow mark 28. Thus the left side projection 8 starts to push the cam disc 13. In this condition, the pressure activated air flows into the right side and lower diaphragm actuating chambers, and at the same time, the air is ejected from the left side and upper diaphram actuating chambers.

Thus the cam disc 13 is continuously rotated only by the injection of pressure activated air at the inlet 16 for alternately reciprocating the transversed drive shafts 7, 7'. Each diaphragm actuating chamber is operated once per rotation of the cam disc 13 to discharge the liquid from the external outlet 5, namely in this embodiment, a desired liquid is discharged four times per rotation of the cam disc 13. The pulsing period of the discharged liquid is, therefore, so short that the liquid is almost continuously absorbed and discharged.

Figure 9:
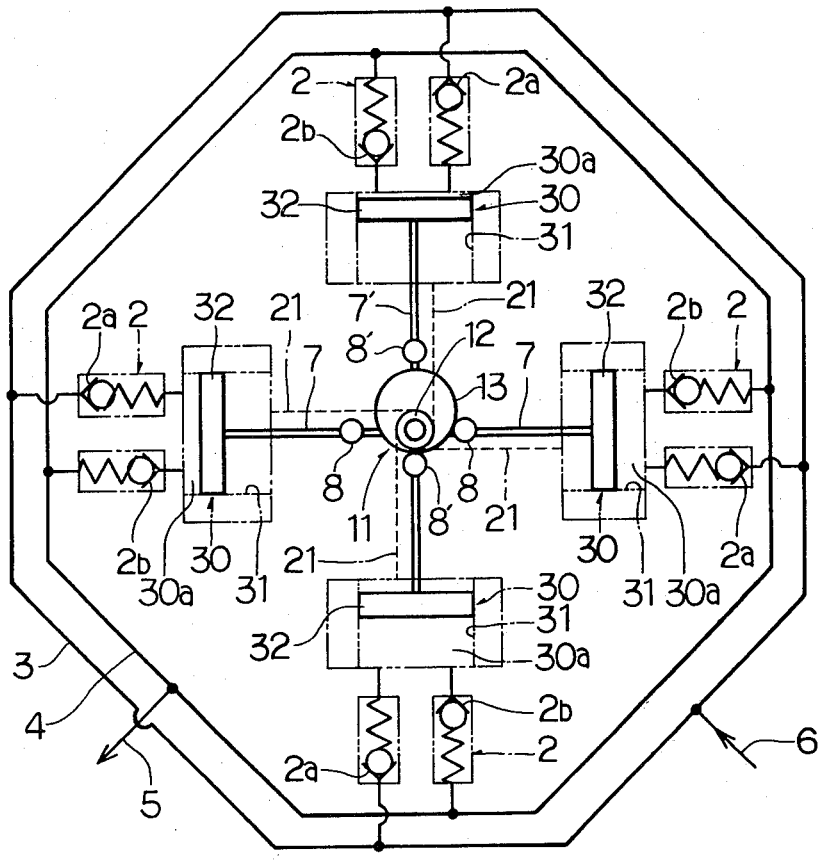
FIG. 9 is a diagrammatic plan view of an alternative embodiment of a reciprocation pump according to the invention.

The diaphragm pumping chamber 1 may be replaced by a piston-type pumping chamber 30 as shown in FIG. 9. The piston-type pumping chamber includes a cylinder 31 and a piston 32 which is located in the cylinder 31 as shown and is slidable lengthwise of the cylinder as a working member. The piston 32 defines a piston actuating chamber 30*a* together with the cylinder 30 and is connected to one end of the drive shaft 7. The piston actuating chamber 30*a* is operatively connected to the external air outlet 16 (FIG. 3) and the external air outlet 20 so that when the piston 32 is slidably reciprocated lengthwise of the cylinder 31, the pumping action described above with respect to FIGS. 1–8 occurs.

As is apparent from the foregoing explanation, the reciprocation pump of this invention is operated, only by injecting the pressure activated fluid such as the air at the external inlet, to absorb and discharge a desired liquid. It has been proved by the actual test that the reciprocation pump of the invention can be positively operated by a pressure activated air of at least 0.5 $kg/cm^2$. It is a matter of course that the maximum air pressure depends upon the strength of the diaphragms, pistons, cylinders, etc., to be employed.

I claim:

1. A reciprocation pump having a plurality of radially arranged reciprocative pumping chambers each provided with a working member and operatively connected to an external liquid absorbing pipe and an external liquid discharging pipe, and a central drive mechanism, said central drive mechanism comprising drive members directly connected to the working members of the radially arranged reciprocative pumping chambers respectively, said drive members being transversely arranged shafts each provided with a pair of abutments, and a valve structure operated in association with the drive members by a pressure activated fluid, said valve structure being so formed as to send the pressure activated fluid into and out of the pump simultaneously during operation thereof, and comprising a rotary fluid switching valve and a cam disc which is coaxial with the former and rotatably driven by the reciprocation mevements of said abutments.

2. A reciprocation pump as defined in claim 1, wherein the working members of said reciprocative pumping chambers are diaphragms.

3. A reciprocation pump as defined in claim 1, wherein the working members of said reciprocative pumping chambers are pistons.

* * * * *

UNITED STATES PATENT AND TRADEMARK OFFICE

CERTIFICATE OF CORRECTION

PATENT NO. : 4,385,869

DATED : May 31, 1983

INVENTOR(S) : Katsumori Omatu

It is certified that error appears in the above—identified patent and that said Letters Patent is hereby corrected as shown below:

Col. 6, Claim 1, line 10, "MEVEMENTS" should be --movements--.

Signed and Sealed this

*Twenty-third* Day of *August 1983*

[SEAL]

*Attest:*

GERALD J. MOSSINGHOFF

*Attesting Officer*

*Commissioner of Patents and Trademarks*